US007886369B2

(12) United States Patent
Nagao et al.

(10) Patent No.: US 7,886,369 B2
(45) Date of Patent: Feb. 15, 2011

(54) GLOVE

(75) Inventors: Hiroshi Nagao, Osaka (JP); Daisuke Kogawa, Osaka (JP); Kazuhiro Kume, Osaka (JP)

(73) Assignee: Mizuno Corporation, Osaka (JP)

( * ) Notice: Subject to any disclaimer, the term of this patent is extended or adjusted under 35 U.S.C. 154(b) by 922 days.

(21) Appl. No.: 11/810,780

(22) Filed: Jun. 7, 2007

(65) Prior Publication Data

US 2008/0000008 A1 Jan. 3, 2008

(30) Foreign Application Priority Data

Jun. 9, 2006 (JP) ..... 2006-161619

(51) Int. Cl.
*A41D 19/00* (2006.01)

(52) U.S. Cl. ..... 2/161.1

(58) Field of Classification Search ..... 2/16, 2/161.1, 161.6

See application file for complete search history.

(56) References Cited

U.S. PATENT DOCUMENTS

| | | | | |
|---|---|---|---|---|
| 5,708,979 | A | 1/1998 | Redwood et al. | |
| 6,415,445 | B1 | 7/2002 | Nishijima et al. | |
| 6,427,247 | B1 * | 8/2002 | Suk | 2/161.2 |
| 6,625,815 | B2 * | 9/2003 | Litke | 2/161.2 |
| 6,862,744 | B2 * | 3/2005 | Kuroda et al. | 2/161.1 |
| 7,694,352 | B2 * | 4/2010 | Kogawa et al. | 2/161.1 |
| 2010/0122396 | A1 * | 5/2010 | Kato | 2/161.1 |

FOREIGN PATENT DOCUMENTS

| | | |
|---|---|---|
| JP | 11-178973 | 7/1999 |
| JP | 3677420 | 5/2005 |
| JP | 2005-281872 | 10/2005 |

* cited by examiner

*Primary Examiner*—Katherine Moran
(74) *Attorney, Agent, or Firm*—Hamre, Schumann, Mueller & Larson, P.C.

(57) ABSTRACT

A glove of the present invention includes a stretchable member and protective members arranged on a side corresponding to a back of a hand, and when the glove is placed in a stationary state and viewed from the back side, the stretchable member forms two or more separate curve surfaces, and upper end portions thereof are located somewhere in lower half parts of finger covering parts, each of the curve surfaces formed with the stretchable member extends toward a wrist part, crossing a center line of at least one finger covering part selected from a second finger (forefinger) covering part, a third finger (middle finger) covering part, a fourth finger (ring finger) covering part, and a fifth finger (little finger) covering part, at least twice in a region from the upper end portions to a normal to the center line of the third finger (middle finger) covering part that passes an interdigit part between the first finger (thumb) covering part and the second finger (forefinger) covering part, and in regions between the curve surfaces of the stretchable member, the protective members are provided. This configuration makes it possible to provide a glove that is capable of following changes in shape caused by a gripping action of the hand, providing both of the feeling of fitting and the feeling of support, and having a high-level protection function and a high-level mobility function.

14 Claims, 11 Drawing Sheets

GLOVE

FIELD OF THE INVENTION

The present invention relates to a glove suitable principally for sports such as golf, baseball, and the like.

BACKGROUND OF THE INVENTION

In a sport such as golf, baseball, or the like that involves the gripping of a club or a bat, gloves are used principally for protecting hands. When a hand assumes a state of gripping a club or a bat from an opened state, the shape of the hand changes significantly. Particularly, the back of the hand has significant changes in shape in the vicinities of the proximal phalanxes and the middle phalanxes. Therefore, if gloves are formed with a non-stretchable material such as leather, the glove is too stiff to provide a feeling of fitting, and the feeling when it is put on is impaired also. In contrast, in the case where gloves are formed exclusively with a mesh material or a stretchable material, a feeling of looseness is provided when it is put on, though good stretchability is obtained.

To solve the above-described problem, it has been proposed to provide notches in regions surrounding capitular parts of the proximal phalanxes of the second finger (forefinger) and the third finger (middle finger), and arrange a stretchable fabric in the notches (Patent Document 1). This proposal makes it possible to reduce discomfort by using a stretchable fabric locally, but the other portions still remain stiff, which leaves a drawback in the feeling when the glove is put on.

As another proposal, a glove is configured so that a feeling of fitting in a gripping state is improved by arranging a stretchable material in a part corresponding to the back of the hand, while an excessive-stretching preventing part is provided partially so as to be superimposed on the stretchable material (Patent Document 2). This proposal has a problem in that since a difference between a stretchable area and a non-stretchable area is too great, a difference between portions is noticeable, for instance, a certain portion fits well to the back of the hand whereas another portion does not fit thereto, and a problem that a feeling of looseness is provided when it is put on although good stretchability is obtained.

Further, as another proposal, a glove is configured so that longitudinal division is provided by arranging individual parts corresponding to respective finger areas, so that the glove follows the lateral stretching between the finger areas (Patent Document 3). However, since the stretching in the longitudinal direction is not taken into consideration, this proposal has a problem in that complicated three-dimensional changes in shape of the back of the hand cannot be followed.

[Patent Document 1] JP 11-178973 A

[Patent Document 2] JP 3677420 B

[Patent Document 3] JP 2005-281872 A

SUMMARY OF THE INVENTION

To solve the above-described problems of the prior art, the present invention provides a glove that is capable of following changes in the shape of a hand caused by a gripping action, providing both of the feeling of fitting and the feeling of being supported (hereinafter referred to as feeling of support), and having a high-level protection function and a high-level mobility function.

A glove of the present invention includes a stretchable member and protective members on a side corresponding to a back of a hand, wherein when the glove is placed in a stationary state and viewed from the back side, the stretchable member forms two or more separate curved surfaces, and upper end portions thereof are located somewhere in lower half parts of finger covering parts; each of the curve surfaces formed with the stretchable member extends toward a wrist part, crossing a center line of at least one finger covering part selected from a second finger forefinger) covering part, a third finger (middle finger) covering part, a fourth finger (ring finger) covering part, and a fifth finger (little finger) covering part, at least twice in a region from the upper end portions to a normal to the center line of the third finger (middle finger) covering part that passes an interdigit part between the first finger (thumb) covering part and the second finger (forefinger) covering part; and in regions between the curve surfaces of the stretchable member, the protective members are provided.

The glove of the present invention can be made capable of following significant changes in shape occurring with a part on the back of the hand extending from upper portions of the metacarpal bones to the vicinities of the proximal phalanxes when the hand assumes a gripping state, providing both of the feeling of fitting and the feeling of support, and having a high-level protection function and a high-level mobility function. More specifically, significant changes in shape that occur to a part on the back of the hand extending from the upper portions of the metacarpal bones to the vicinities of the proximal phalanxes in a gripping action of the hand are absorbed by surfaces defined by the first curves from the upper end of the stretchable member and surfaces defined by the next curves, and the stretchable member is stretched in the longitudinal, lateral, and oblique directions. This allows the glove to follow changes in shape of the hand while being fitted to the entirety of the hand, and to maintain a high-level mobility function. Besides, since the protective members are formed in regions between the portions of the stretchable member, the glove provides the feeling of support, and has a high-level protection function.

Figure 9:
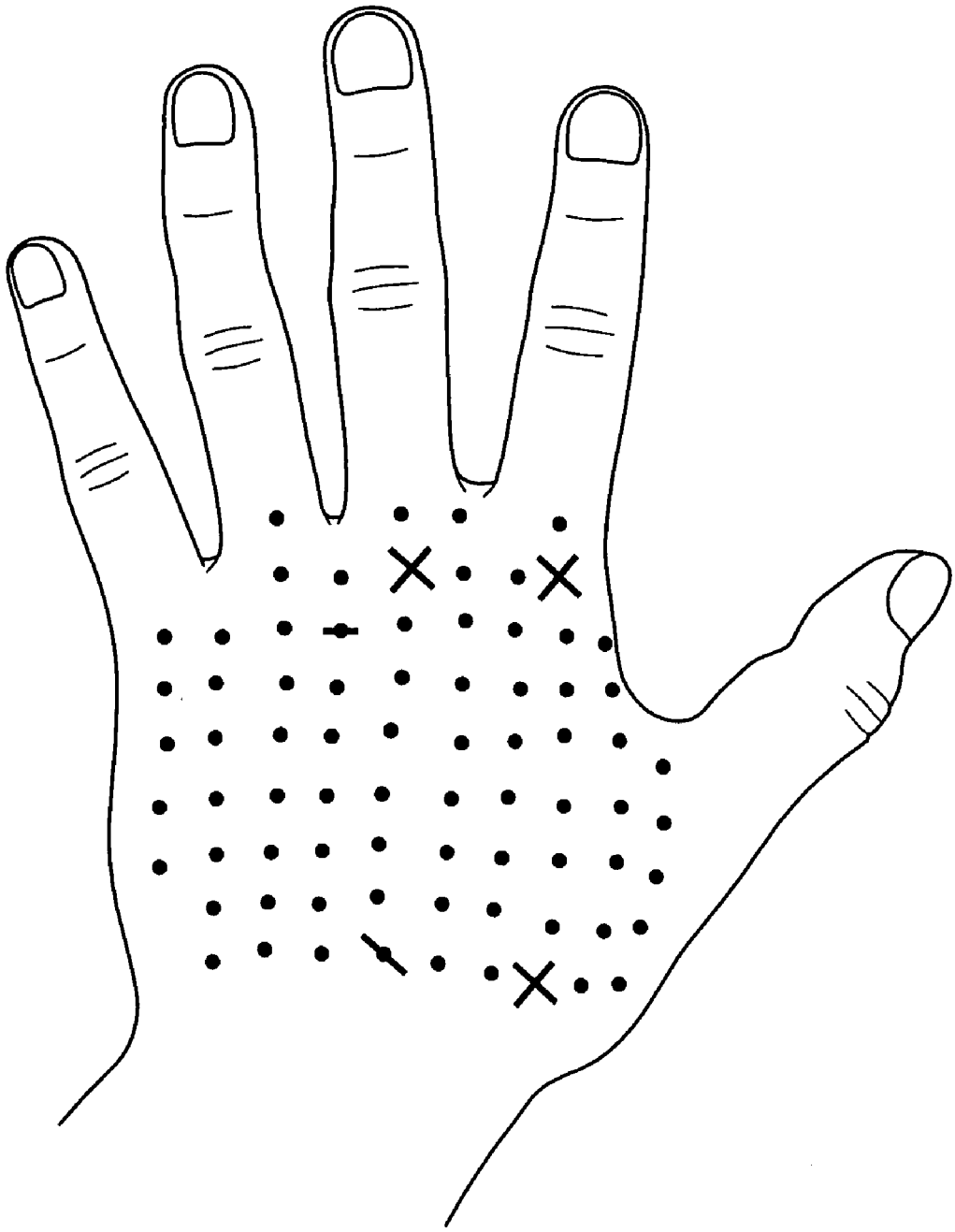
FIG. 9 is an explanatory view illustrating changes in shape of the hand in an example of the present invention.
Figure 10:
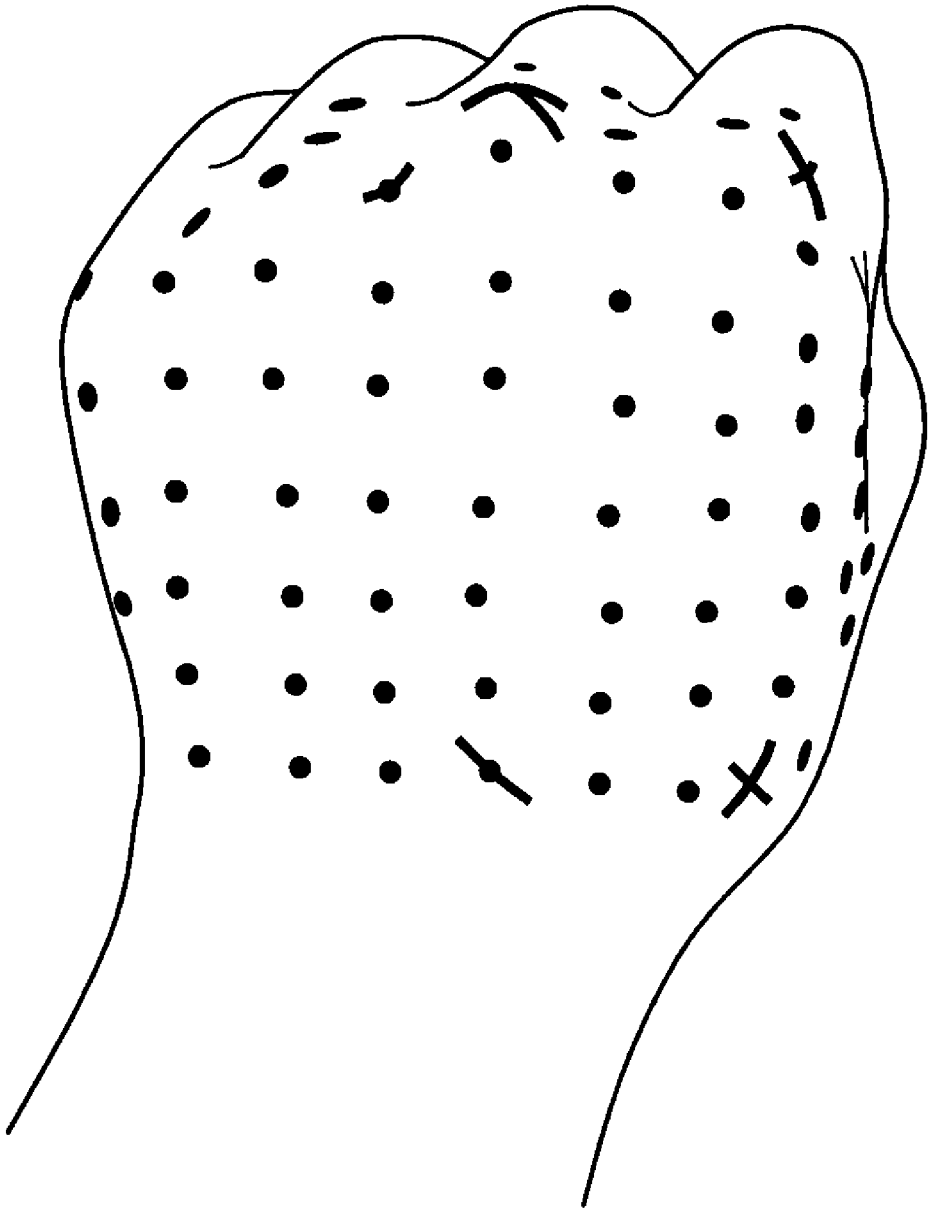
FIG. 10 is an explanatory view illustrating changes in shape that occur when the hand assumes a gripping state.

The inventors of the present invention observed a change in shape of the back of the hand when the hand assumed a gripping state. First, as shown in FIG. 9, dots were provided in the matrix form on the back of the hand, while a cross, a horizontal line, and a straight line were drawn on the dots to be noticed, so as to analyze in detail what changes in shape occurred when the hand assumed a gripping state, as shown in FIG. 10. The part stretched out in the longitudinal and lateral directions as a whole as shown by the dots in the matrix form, whereas portions where the crosses, the horizontal line, and the straight line were drawn stretched in oblique directions. Thus, it was found that a complicated motion occurred. The conception of the present invention was to develop a glove capable of following a motion of the back of the hand that involves such a complicated three-dimensional changes in shape.

Figure 11:
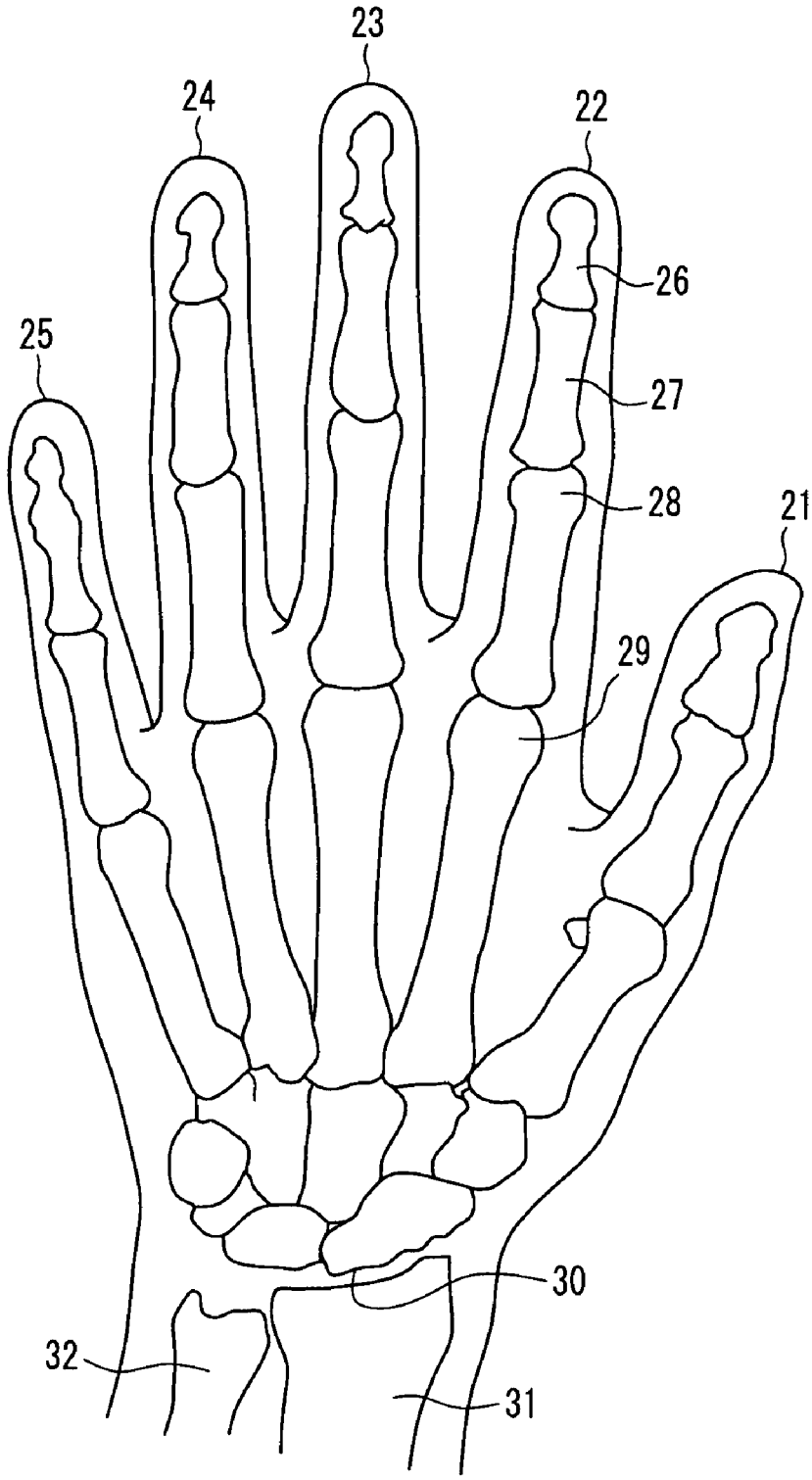
FIG. 11 explains the bones of the hand and fingers.

For the description of the present invention, first of all, bones of the hand and fingers are described. FIG. 11 is a perspective view of the left hand of a human viewed from the side of the back of the hand. The hand and fingers are composed of the first finger (thumb) 21, the second finger (forefinger) 22, the third finger (middle finger) 23, the fourth finger (ring finger) 24, and the fifth finger (little finger) 25. Each finger, for example, the second finger forefinger) 22, is composed of a distal phalanx 26, a middle phalanx 27, and a proximal phalanx 28 from the distal side, and is connected to a metacarpal bone 29. The metacarpal bone 29 is connected to other small bones, which are connected to a carpal 30. A radius 31 and a ulna 32, which are bones of the arm, are present facing the carpal 30. Normally, the "wrist" refers to an area extending from the vicinity of the carpal 30 to the vicinity of the ends of the radius 31 and the ulna 32.

Figure 2:
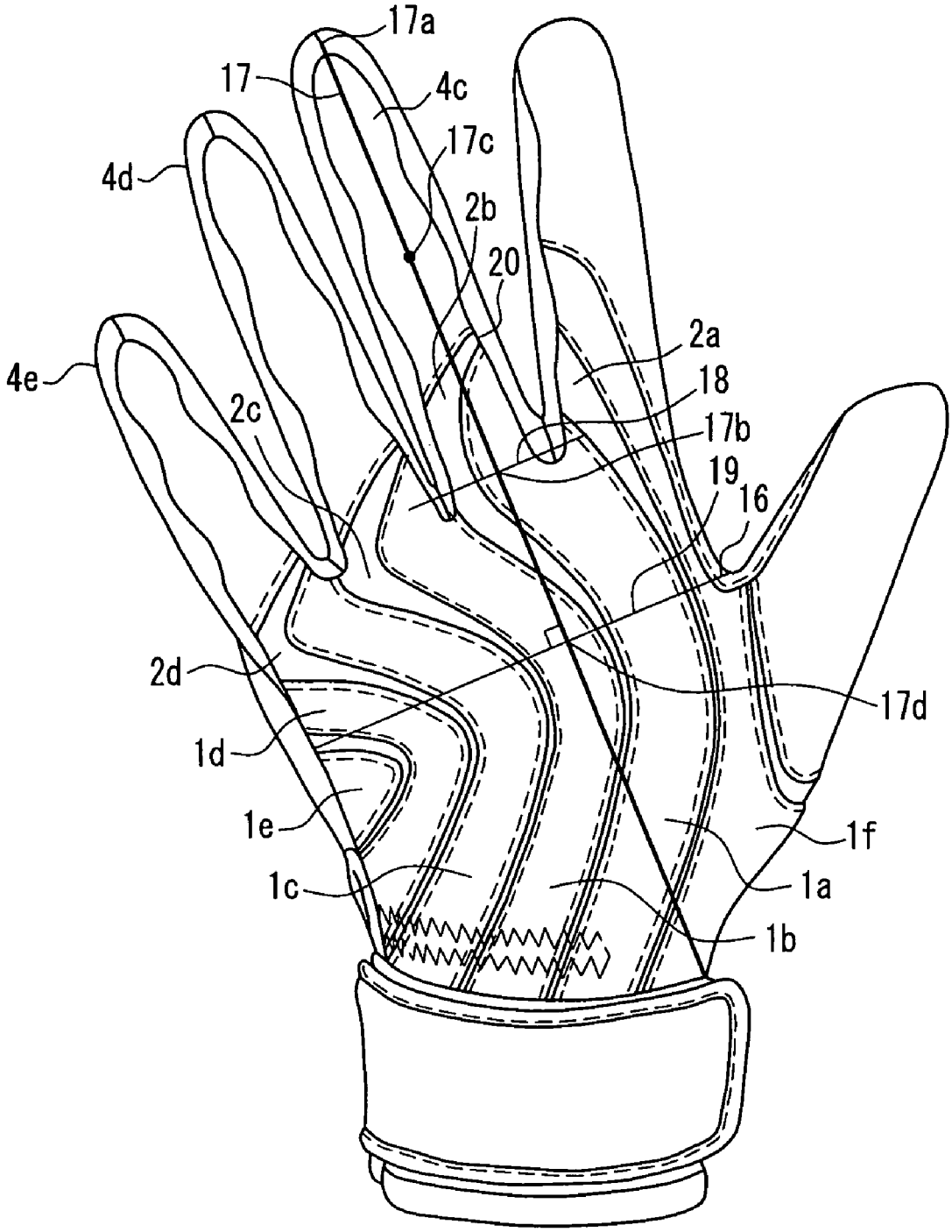
FIG. 2 is a rear view of the glove when it is placed in a normal stationary state, in which explanatory descriptions are added.

A glove of the present invention is, as shown in FIG. 2 as an example, configured as follows. A stretchable member (2*a* to 2*d*) and protective members (1*a* to 1*f*) are arranged on a side corresponding to the back of the hand (the part corresponding to the back of the hand is hereinafter referred to as "back part", and the side of this part of the glove is hereinafter referred to as "back side". When the glove is placed in a stationary state and viewed from the back side, the stretchable member (2*a* to 2*d*) forms two or more separate curve surfaces, and upper end portions thereof are located somewhere in lower half parts of finger covering parts (4*b* to 4*e*). Each of the curve surfaces formed with the stretchable member extends toward the wrist, crossing a center line of at least one finger covering part selected from a second finger (forefinger) covering part, a third finger (middle finger) covering part, a fourth finger (ring finger) covering part, and a fifth finger (little finger) covering part, at least twice in a region from the upper end portions to a normal to the center line (17) of the third finger (middle finger) covering part that passes an interdigit part (16) between the first finger (thumb) covering part and the second finger (forefinger) covering part (for example, in the case of the middle finger, in a region from the upper end of the middle finger covering part to a crossing point (17*d*)). In regions between the curve surfaces of the stretchable member (2*a* to 2*d*), the protective members (1*a* to 1*f*) are provided. With this configuration, the glove is capable of following changes in shape caused by a gripping action of the hand, providing both of the feeling of fitting and the feeling of support, and maintaining a good protection function and a good mobility function. In the present invention, the "curve surface" refers to a "surface defined by curves". The "stationary state" refers to a state in which the glove is in an opened, settled state.

In the foregoing description, the lower half parts of the finger covering parts (4*b* to 4*e*) are equivalent to parts covering the proximal phalanxes. Therefore, by forming the stretchable member (2*b* to 2*d*) so that the upper end of each curve surface is a certain portion covering a proximal phalanx of at least one finger selected from the second finger (forefinger), the third finger (middle finger), the fourth finger (ring finger) and the fifth finger (little finger) while the lower ends thereof are certain portions on a side lower than a line 19, the glove is allowed to follow significant changes in shape occurring with a part on the back of the hand extending from upper portions of the metacarpal bones to the vicinities of the proximal phalanxes.

It is preferable that each of the protective members (1*a* to 1*f*) is formed so as to cover at least a part of the metacarpal bone continued to at least one finger selected from the second finger (forefinger), the third finger (middle finger), the fourth finger (ring finger), and the fifth finger Little finger). This allows the glove to exhibit the protection function for protecting the back of the hand and the feeling of support.

It is preferable that the protective members are arranged on the stretchable member, and they are integrated with each other by sewing or bonding. This facilitates the sewing or bonding, and reduces the possibility of losing the shape. For sewing, stitches may be formed by a lock stitch sewing machine, a chain stitch sewing machine, a 1-needle overlock sewing machine, a 2-needle overlock sewing machine, or a flat seamer, etc. However, the type of stitches is not limited to these. For bonding, for example, a method is used in which hot pressing is performed by using a polyurethane seam tape that is molten with heat. A product may be formed by fixing various protective sections to a single sheet of a stretchable material that can define various stretchable portions.

Each width of the curve surfaces of the stretchable member is smaller than that of the protective members. Preferably, the foregoing width is not more than ¾ of a maximum finger width of a back portion of the third finger (middle finger) covering part, the maximum finger width being taken in a direction perpendicular to the center line of the back portion of the third finger covering part, and more preferably, not more than ⅔ of the same. This configuration allows the glove to maintain the high-level protection function for protecting the hand without impairing the mobility function.

It is preferable that when the glove is placed in a stationary state and is viewed from the back side, the shape of each of the curve surfaces formed with the stretchable member is in the shape of a letter S, a reversed letter S, or a combination of these. This configuration allows the glove to follow significant changes in shape of the hand by the stretching functions of the stretchable member for stretching in the longitudinal, lateral, and oblique directions.

It is preferable to use a two-way stretchable knitted fabric for forming the stretchable member. This is because it follows significant changes in the longitudinal and lateral directions. Preferably, an extension ratio of a 5 cm-wide piece of the stretchable member under a load of 4.9 N (500 gf) is in a range of 5 to 150% both in the warp and weft directions. The stretchable member may be formed with a knitted fabric or a woven fabric formed with a combination of fibers selected from, for example, polyurethane fibers, polyamide fibers, and polyester fibers.

It is preferable that the first arc from the upper end of each protective member has a curvature such that a radius (R) is in a range of not less than 3 mm and not more than 20 mm. Besides, with the center of the upper end of each curve surface of the stretchable member being assumed to be a base point, it is preferable that an angle formed between a line extended from the base point to a top of a bulge of the first arc of the stretchable member and a line extended from the top of the bulge of the first arc to a top of a bulge of the next arc thereof is in a range of not less than 80° and not more than 110°. This configuration also allows the glove to follow significant changes in shape of the hand by the stretching function of the stretchable member for stretching in the longitudinal, lateral, and oblique directions.

At positions corresponding to capitular parts of the middle phalanxes, on the back side of the glove, notch-like portions formed with stretchable members may be provided in parallel with the first arcs. This configuration allows the glove to follow significant changes in shape at the positions corresponding to the capitular parts of the middle phalanxes.

Preferably, the protective members are formed with a natural leather, a synthetic leather, or an artificial leather. This is intended to maintain a a protection function at a high level. Here, the "natural leather" refers to leather of an animal such as cowskin, pigskin, sheepskin, buckskin, or the like. The "synthetic leather" refers to a woven or knitted fabric made of nylon or the like whose surface is coated with a synthetic resin such as a polyurethane resin or a vinyl chloride resin. The "artificial leather" refers to a non-woven fabric as a base whose surface is coated with a synthetic resin such as a polyurethane resin, a polyamino acid resin, a nylon resin, or a vinyl chloride resin, and is subjected to surface treatment, for example, so as to be sueded.

It should be noted that preferably the protective member is extended to the wrist part. The stretchable member may be configured so that an end thereof overlaps an elasticized constriction part in the wrist part, or alternatively, so that an end thereof does not overlap the constriction part. Further alternatively, the stretchable member may be terminated at a certain position between the line 16 and the wrist part.

EXAMPLES

The present invention will be described in more detail by referring to examples shown below.

Example 1

Figure 1:
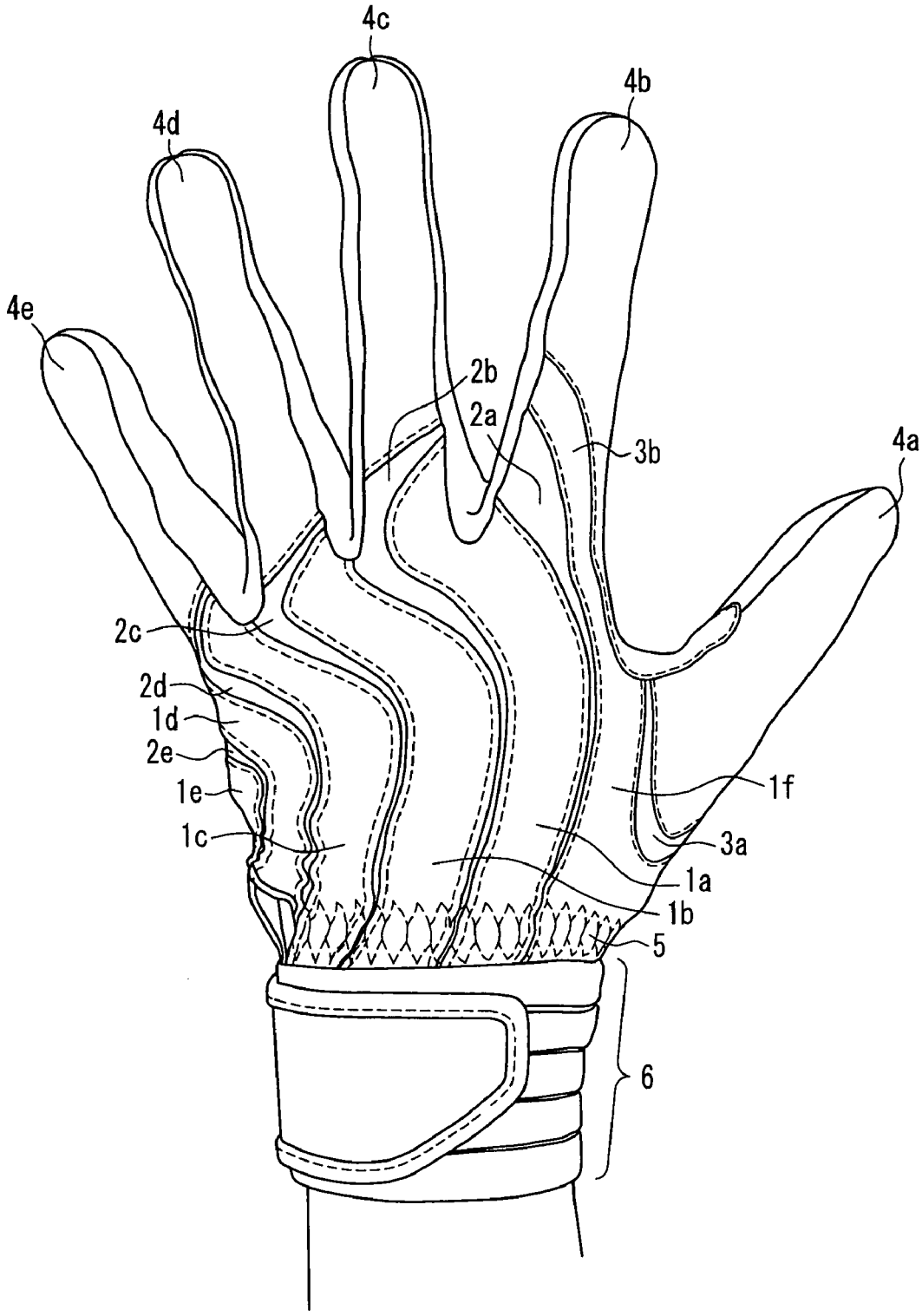
FIG. 1 is a rear view of a glove for use in baseball according to Example 1 of the present invention.

FIG. 1 shows a back side of a glove for use in baseball according to an example of the present invention. On a back part of this glove, protective members (1*a* to 1*c*) were configured to be three or more separate linear pieces made of a natural leather, a synthetic leather, or an artificial leather. Additional protective members (1*d* to 1*e*) were provided on the little finger side to the foregoing three linear pieces, and an additional protective member (1*f*) was provided on the thumb side to the three linear pieces. As shown in FIG. 2 that shows the glove placed in a stationary state and viewed from the back side, four separate curve surfaces whose upper ends were located at certain positions in lower half parts of finger covering parts (4*b* to 4*e*) were formed with a stretchable member (2*a* to 2*d*). Each of the curve surfaces formed with the stretchable member was extended toward the wrist, crossing each center line of the finger covering parts at least twice in a region from the upper end portions to a crossing point of the center line and a normal to the center line (17) of the third finger (middle finger) covering part that passed an interdigit part (16) between a first finger (thumb) covering part and a second finger (forefinger) covering part. The protective members (1*a* to 1*f*) are arranged in regions between the curve surfaces of the stretchable member (2*a* to 2*d*). The upper ends of the stretchable member (2*b* to 2*d*) were certain portions covering the proximal phalanxes of the second finger (forefinger), the third finger (middle finger), the fourth finger (ring finger), and the fifth finger little finger), while the lower ends thereof were extended from positions lower than a line 19 to the vicinities of the wrist. Each of the curve surfaces of the stretchable member (2*a* to 2*d*) was in the shape of a letter S.

The protective members (1*a* to 1*f*) were arranged on the stretchable member (2*a* to 2*e*), and were attached by sewing. This facilitated the sewing, and reduced the possibility of losing the shape.

Each width of the curve surfaces of the stretchable member (2*a* to 2*e*) was smaller than that of the protective members (1*a* to 1*f*), and was set to be not more than half of a maximum finger width of the third finger (middle finger) covering part. This configuration allows the glove to maintain the protection function for protecting the hand at a high level without impairing the mobility function.

FIG. 2 is an explanatory view for FIG. 1. 16 denotes an interdigit part between the thumb and the forefinger, 17 denotes a center line of the middle finger covering part, 17*a* denotes an end of the center line 17, 17*b* denotes a crossing point of the center line 17 and a line 18 extended along a base of the middle finger, 17*c* denotes a midpoint between the point 17*a* and the point 17*b*, 17*d* denotes a crossing point of the lines 17 and 16, 19 denotes a normal from an interdigit between the thumb covering part and the forefinger covering part to the center line 17, and 20 denotes an end of the stretchable member.

Figure 3:
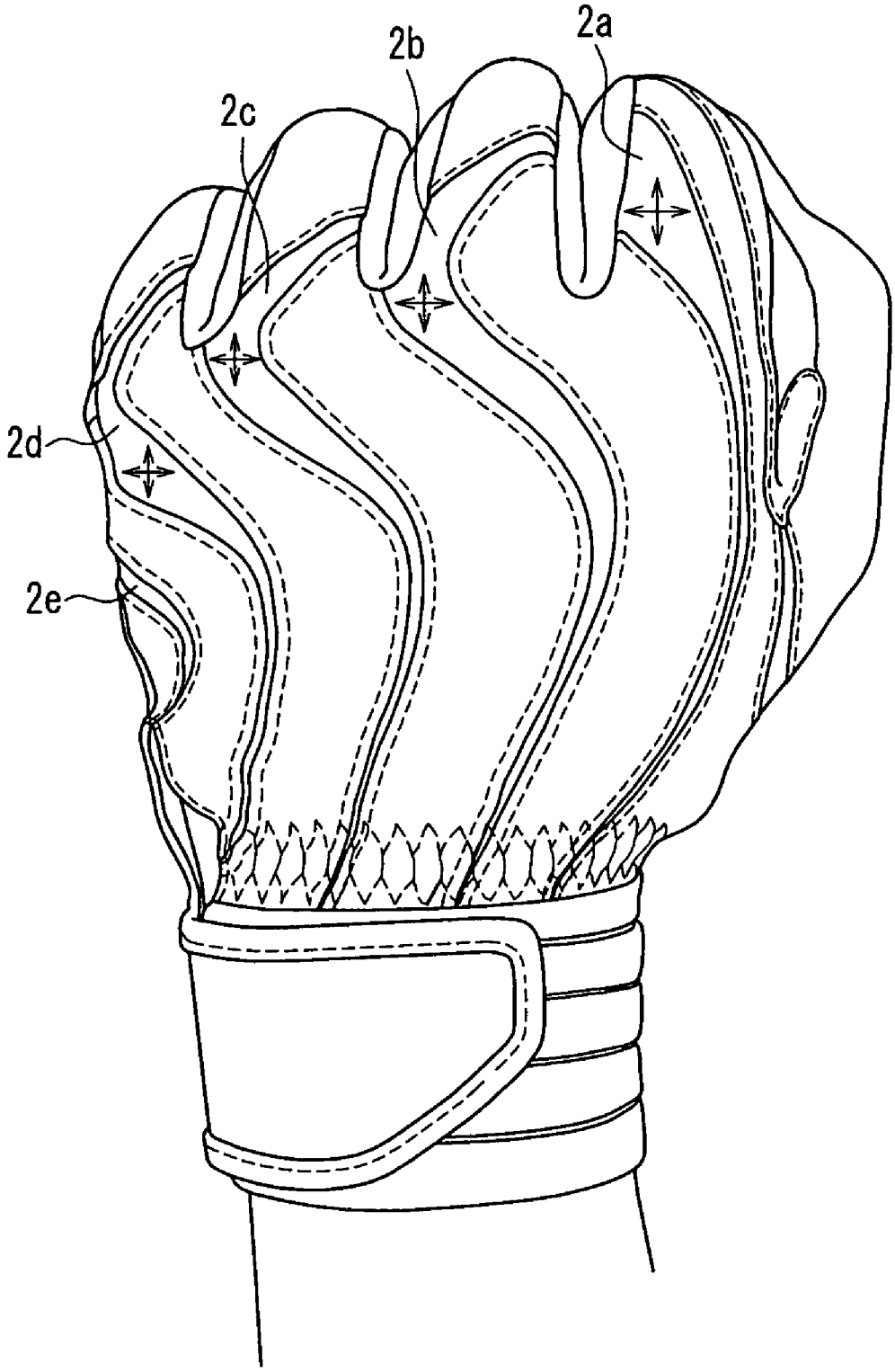
FIG. 3 is a rear view of the glove when a hand puts on the glove and is gripping.

In the present example, each curve surface of the stretchable member is in the shape of a letter S. This allowed the glove to follow significant changes in shape of the hand by the stretching function of the stretchable member for stretching in the longitudinal, lateral, and oblique (bias) directions. This is shown in FIG. 3. The greatly curved portions of the curve surfaces of the stretchable member (2*a* to 2*e*) were stretched in X and Y directions (longitudinal and lateral directions), as well as in an oblique direction, which is not shown in the drawing. This stretching allows the hand to assume a gripping state without causing discomfort.

Figure 4:
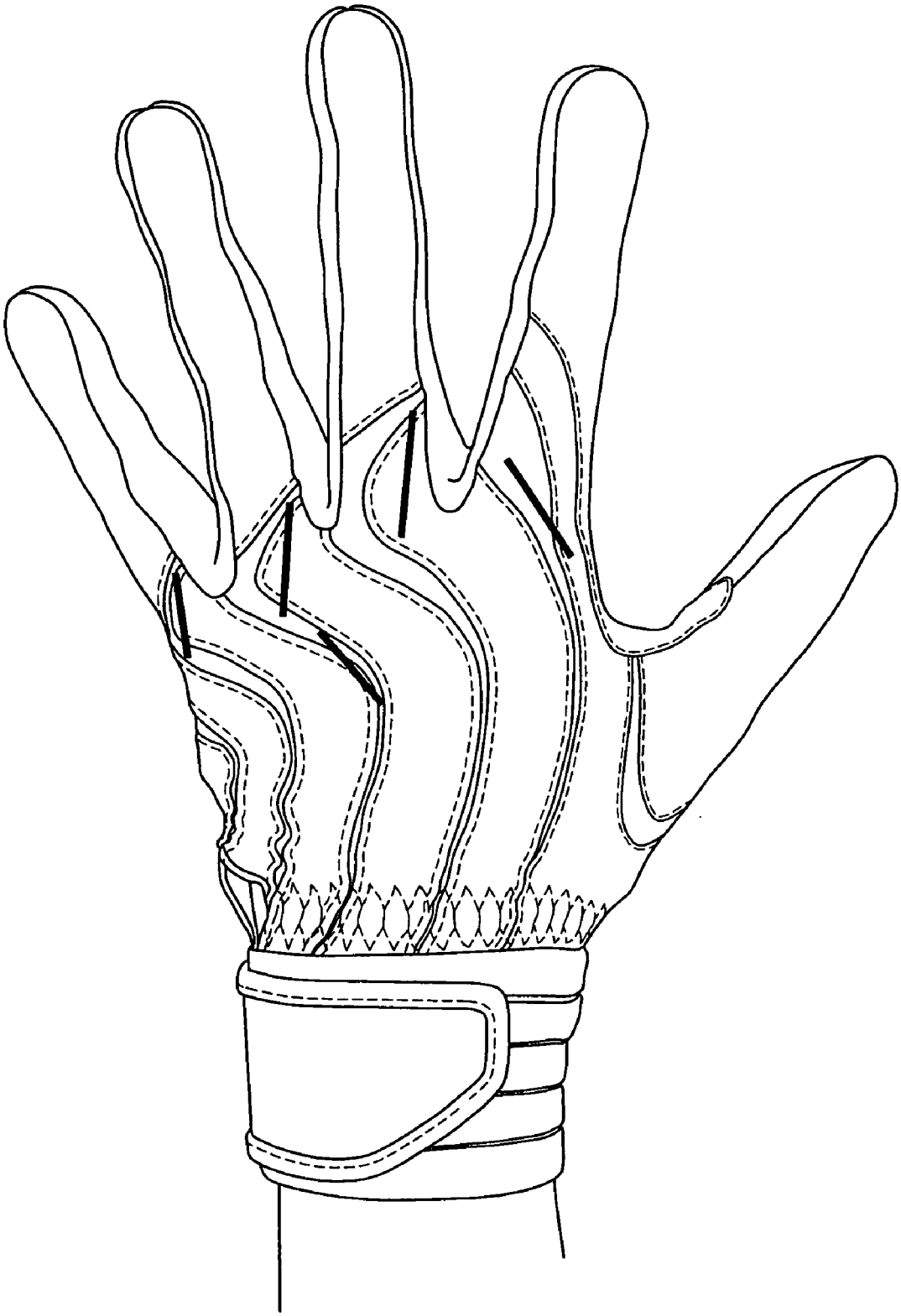
FIG. 4 is an explanatory view in which thick lines indicate the parts with which significant changes in shape have occurred when the hand is opened from the state shown in FIG. 3.

FIG. 4 is an explanatory view showing, with thick lines, which parts significant changes in shape occurred with, when the hand in the state shown in FIG. 3 assumed a state with the fingers being stretched out. It can be seen that significant changes in shape occurred in a region from upper parts of the metacarpal bones to the vicinities of the proximal phalanxes, and the changes involved not only the stretching in the longitudinal direction but also the stretching in the lateral direction, thereby resulting in changes in shape in the oblique direction.

Figure 5:
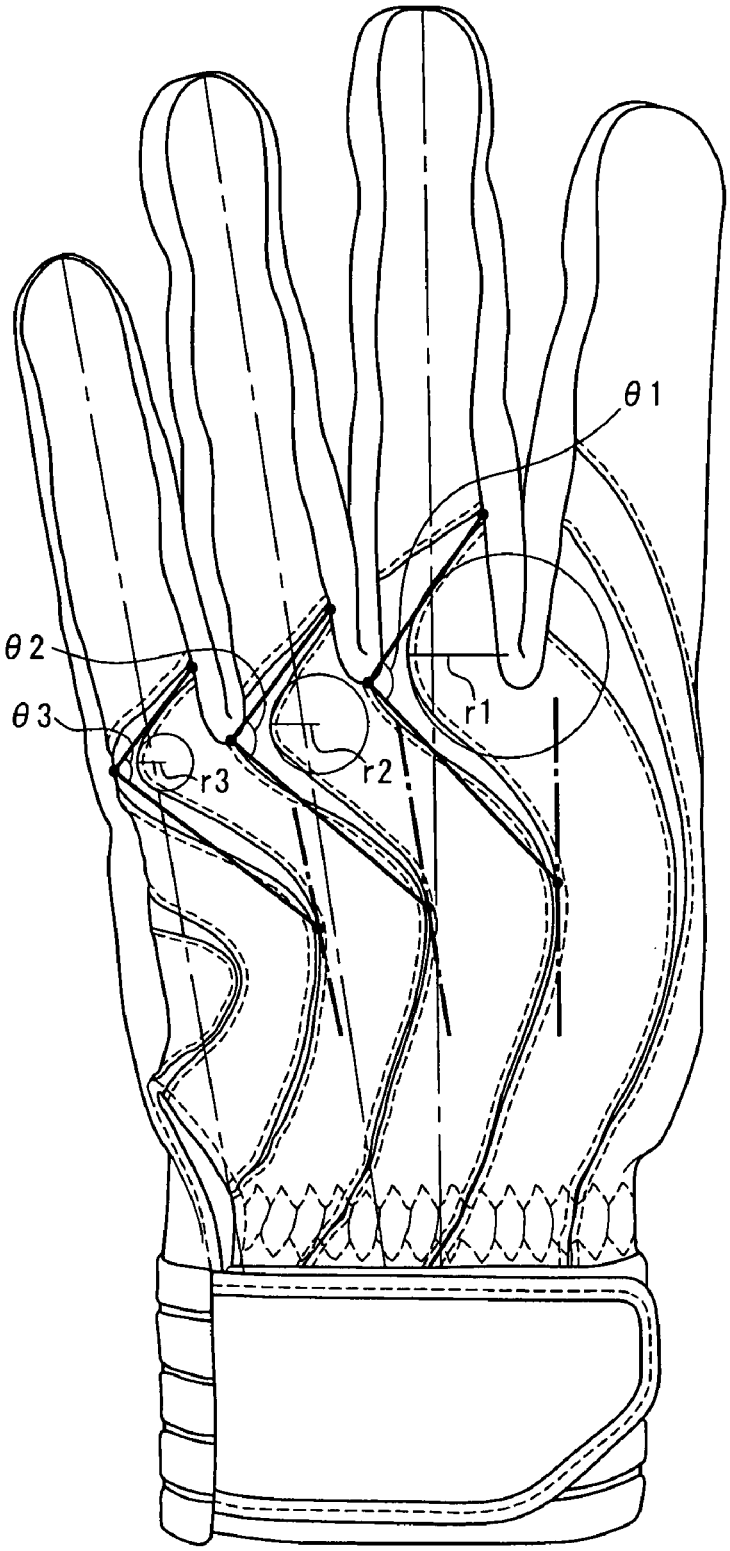
FIG. 5 is a rear view for explaining a design of the glove.

As shown in FIG. 5, a first arc from the upper end of the protective member in the lower part of the middle finger had a curvature such that a radius (r1) was 15 mm, an arc in the lower part of the ring finger had a curvature such that a radius (r2) was 7.5 mm, and an arc in the lower part of the little finger had a curvature such that a radius (r3) was 4 mm. With the center of the upper end of the stretchable member in the lower part of the middle finger being assumed to be a base point, an angle θ1 formed between a line extended from the base point to the top of the bulge of the first arc of the curve surface of the stretchable member and a line extended from the top of the bulge of the first arc to the top of the bulge of the next arc thereof was set to 100°, an angle θ2 in the lower part of the ring finger was set to 92°, and an angle θ3 in the lower part of the little finger was set to 84°. This configuration also allows the glove to follow significant changes in shape of the hand by the stretching functions of the stretchable member for stretching in the longitudinal and lateral directions.

In the present example, as shown in FIG. 1, protective members (4*a* to 4*e*) were provided in finger end areas. This configuration reinforces the protection of the fingers in the end areas thereof.

It should be noted that in FIG. 1, 5 denotes an elasticized constriction part, and 6 denotes a strap for protecting the wrist, which is fastened by a fastening tape. The strap 6 for protecting the wrist is unnecessary for a glove for use in golf.

The members of the glove for use in baseball according to the above-described example are as follows.

(1) Protective members for the back part and the finger back portions:

natural sheepskin with a density of 297 g/m$^2$.

(2) Protective member (integrated form) from a palm part to finger front portions, and protective member on a thumb front portion:

natural sheepskin with a density of 297 g/m$^2$.

(3) Stretchable member on the back part:

two-way knitted fabric with a density of 215 g/m$^2$ made of polyester and polyurethane fibers; an extension ratio of a 5 cm-wide piece of the fabric under a load of 4.9 N (500 gf) was 82% in the warp direction and 75% in the weft direction.

(4) Stretchable member on finger side portions:

two-way knitted fabric with a density of 215 g/m$^2$ made of nylon and polyurethane fibers; an extension ratio of a 5 cm-wide piece of the fabric under a load of 4.9 N (500 gf) was 82% in the warp direction and 75% in the weft direction.

A glove was formed by sewing the above-described members, and when it was put on the hand and transformed from an opened state to a gripping state, it was recognized that the glove was capable of following significant changes in shape of the back of the hand in an area from the vicinities of the proximal phalanxes to the vicinities of the middle phalanxes, providing both of the feeling of fitting and the feeling of support, and having a high-level protection function and a high-level mobility function. In other words, the stretchable members were stretched in the longitudinal, lateral, and oblique directions in response to significant changes in the shape of the hand, whereby the glove was capable of following the changes in the shape of the hand while maintaining fit to the entirety of the hand, and allowing the hand to assume a gripping state without discomfort. Besides, the glove provided a feeling of support and had a high-level protection function.

Example 2

Figure 6:
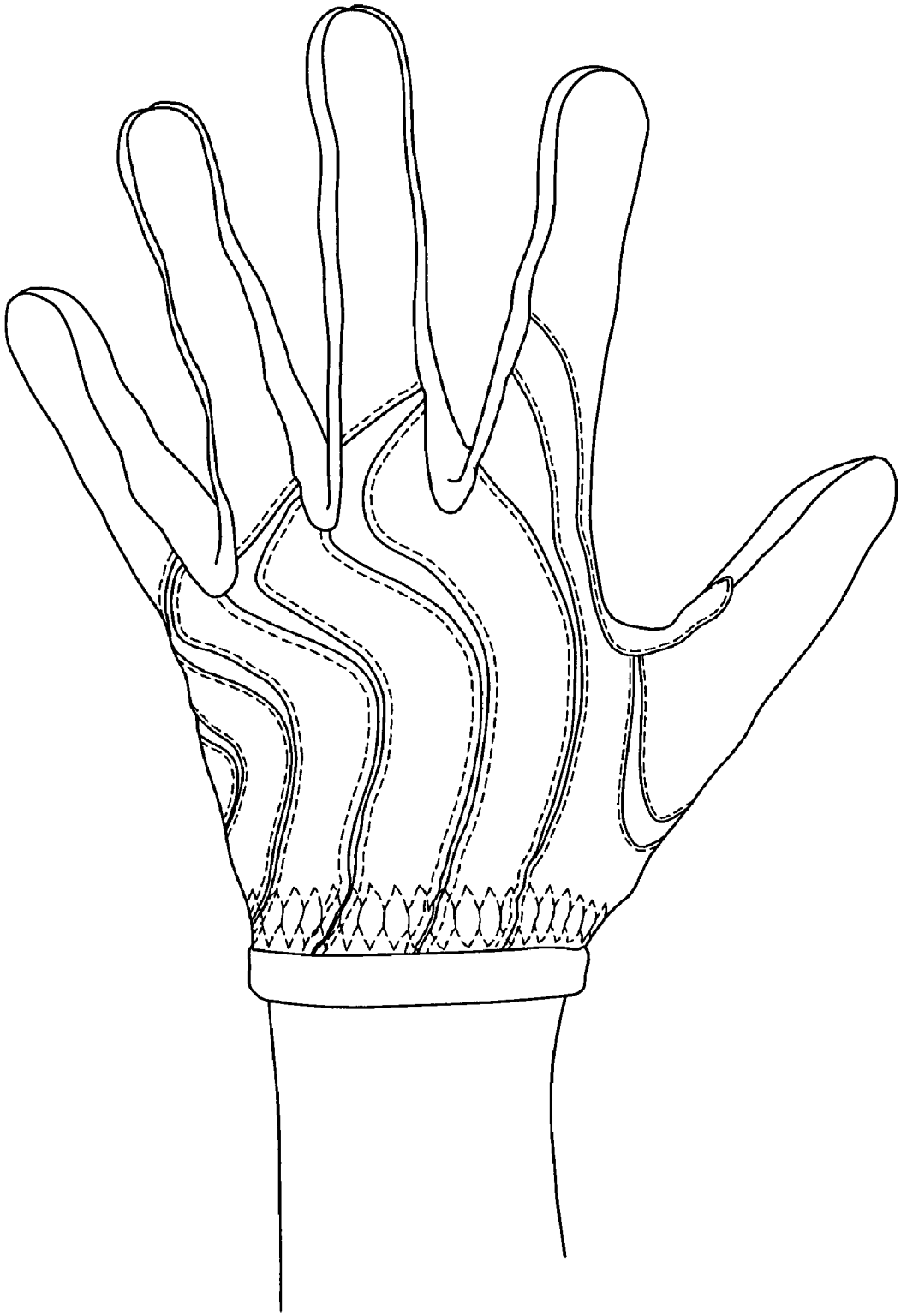
FIG. 6 is a rear view of a glove for use in golf according to Example 2 of the present invention.

A glove was formed in the same manner as that of Example 1 except that the strap 16 for the wrist was omitted. The glove is shown in FIG. 6. FIG. 6 shows a back side of the glove for use in golf according to Example 2 of the present invention. This glove was used in playing golf, and it was recognized that the glove was capable of following changes in shape of the back of the hand in an area from the vicinities of the proximal phalanx to the vicinities of the middle phalanxes, providing both of the feeling of fitting and the feeling of support, and maintaining a high-level protection function and a high-level mobility function, as in Example 1. In other words, the stretchable members were stretched in the longitudinal, lateral, and oblique directions in response to significant changes in the shape of the hand, whereby the glove was capable of following the changes in the shape of the hand while maintaining fit to the entirety of the hand, and allowing the hand to assume a gripping state without discomfort. Besides, the glove provided a feeling of support and had a high-level protection function.

Example 3

Figure 7:
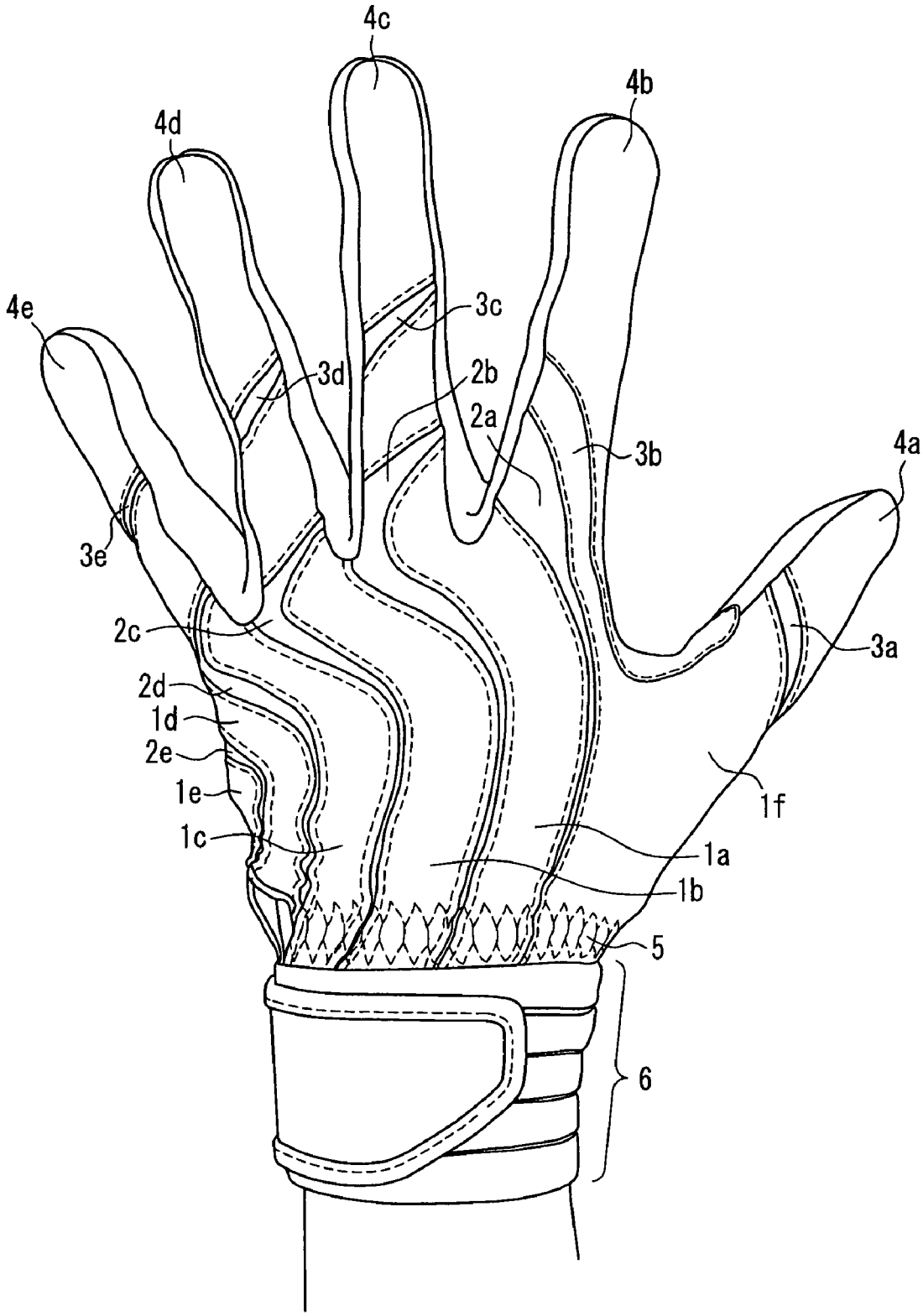
FIG. 7 is a rear view of a glove for use in baseball according to Example 3 of the present invention.

FIG. 7 shows a glove of Example 1 in which notch-like portions (3*a* to 3*e*) formed with stretchable members were provided additionally in the back portions of the finger covering parts, so as to be parallel with the first arcs, at positions corresponding to capitular parts of the middle phalanxes. This configuration allowed the glove further to follow significant changes in shape at the capitular parts of the middle phalanxes.

Example 4

Figure 8:
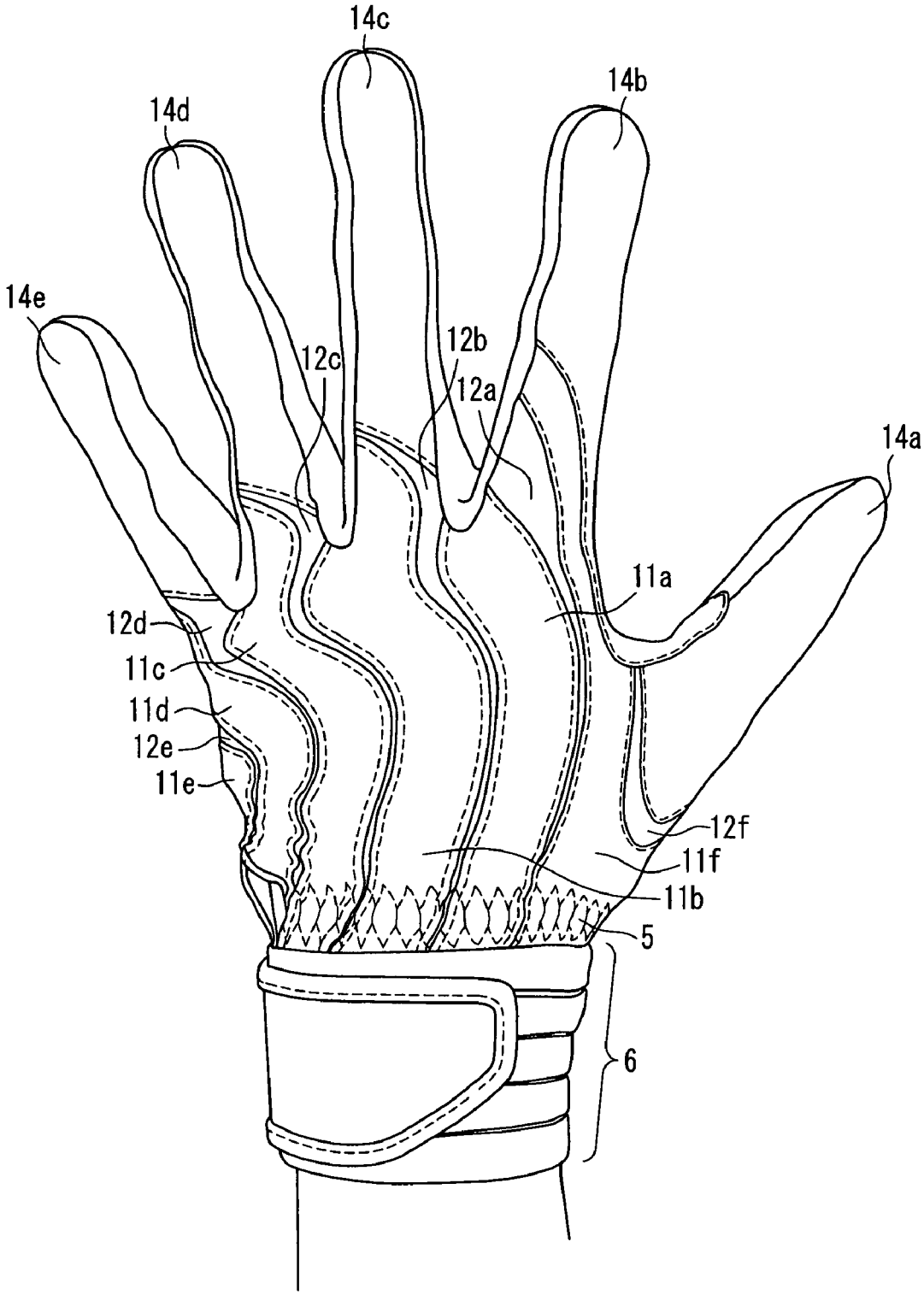
FIG. 8 is a rear view of a glove for use in baseball according to Example 4 of the present invention.

FIG. 8 shows a back side of a glove for use in baseball according to another example of the present invention. This example is different from Example 1 in the following points.

(1) Protective members (11*a* to 11*d*) made of a natural leather had upper ends thereof at certain positions in areas covering the proximal phalanxes of the second finger (forefinger), the third finger (middle finger), the fourth finger (ring finger), and the fifth finger (little finger), and lower ends at the wrist part.

(2) A stretchable member (12*b* to 12*d*) appeared between the protective members (11*a* to 11*d*), and the stretchable member (12*b* to 12*d*) appearing in interstices between at least three of the protective members (11*a* to 11*d*) formed curve surfaces, each of which included a S-shaped portion and a different-direction portion directed in a reverse direction connected to the S-shaped portion.

A glove was formed in the same manner as that of Example 1 except for the foregoing points. In FIG. 8, 11*e* and 11*f* denote protective members, 12*e* and 12*f* denote a stretchable member, 14*a* to 14*e* denote protective members in the finger end areas, 5 denotes an elasticized constriction part, and 6 denotes a strap.

When a glove formed in this way was put on the hand and transformed from an opened state to a gripping state, it was recognized that the glove was capable of following significant changes in shape of the back of the hand in an area from the vicinities of the proximal phalanxes to the vicinities of the middle phalanxes, providing both of the feeling of fitting and the feeling of support, and having a high-level protection function and a high-level mobility function. In other words, the stretchable members were stretched in the longitudinal, lateral, and oblique directions in response to significant changes in shape of the hand, whereby the glove was capable of following the changes in shape of the hand while remaining fit to the entirety of the hand, and allowing the hand to assume a gripping state without discomfort. Besides, the glove provided a feeling of support and had a high-level protection function. The protection function of the glove in Example 3 was further higher as compared with the glove of Example 1.

A glove I formed according to Example 1, a conventional glove II (Comparative Example 1) an entirety of which was formed with a natural leather, and a glove III (Comparative Example 2) in which a part in an area above the line 16 and below the point 20 shown in FIG. 2 was formed entirely with the stretchable fabric (two-way knitted fabric) used in Example 1 were prepared and worn by nine baseball players so as to be tested. The results of the test are shown in Table 1.

TABLE 1

| Wearer | Feeling of fitting | | | Feeling of support (Feeling of hold) | | | Balance of feeling of fitting and feeling of support | | |
|---|---|---|---|---|---|---|---|---|---|
| | Glove I | Glove II | Glove III | Glove I | Glove II | Glove III | Glove I | Glove II | Glove III |
| A | 2 | 3 | 1 | 2 | 1 | 3 | 1 | 2 | 3 |
| B | 1 | 3 | 2 | 2 | 1 | 3 | 1 | 2 | 3 |
| C | 2 | 3 | 1 | 1 | 2 | 3 | 1 | 2 | 3 |
| D | 2 | 3 | 1 | 2 | 1 | 3 | 1 | 2 | 3 |
| E | 1 | 3 | 2 | 1 | 2 | 3 | 1 | 2 | 3 |
| F | 1 | 3 | 2 | 2 | 1 | 3 | 1 | 2 | 3 |
| G | 2 | 3 | 1 | 2 | 1 | 3 | 1 | 2 | 3 |
| H | 2 | 3 | 1 | 3 | 1 | 2 | 2 | 3 | 1 |
| I | 2 | 3 | 1 | 1 | 2 | 3 | 1 | 2 | 3 |

Note:
Ranking (1: Best, 2: Middle, 3: Worst)

It was recognized from the results described above that the product according to the example of the present invention (glove I) exhibited the best balance of the feeling of fitting and the feeling of support. Besides, as compared with the glove III (Comparative Example 2), the product according to the example of the present invention (glove I) exhibited a superior protection function over the area on the back of the hand from the upper portions of the metacarpal bones to the vicinities of the proximal phalanxes.

INDUSTRIAL APPLICABILITY

The glove of the present invention can be used suitably in sports such as golf, baseball, tennis, badminton, squash racquets, ski, mountaineering, and walking, as well as in riding a motorbike, a bicycle, etc.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A glove comprising:

a palm side, a back side and finger covering parts assembled together to form the glove, and a stretchable member and protective members on the back side of the glove, wherein when the glove is placed in a stationary state and viewed from the back side, two or more curve surfaces separated from each other are formed by the stretchable member, and upper end portions thereof are located somewhere in lower half parts of the finger covering parts, each of the curve surfaces formed by the stretchable member extends toward a wrist part, crossing a center line of at least one finger covering part selected from a second finger (forefinger) covering part, a third finger (middle finger) covering part, a fourth finger (ring finger) covering part, and a fifth finger (little finger) covering part, at least twice in a region from the upper end portions to a normal to the center line of the third finger (middle finger) covering part that passes an interdigit part between the first finger (thumb) covering part and the second finger (forefinger) covering part, and the protective members are provided in regions adjacent to the curve surfaces of the stretchable member.

2. The glove according to claim 1, wherein each of the protective members is formed so as to cover at least a part of the metacarpal bone connected to at least one finger selected from the second finger (forefinger) and third finger (middle finger), the forth finger (ring finger) and the fifth finger (little finger).

3. The glove according to claim 1, wherein the protective members are arranged on the stretchable member, and they are integrated with each other by at least one selected from sewing and bonding.

4. The glove according to claim 1, wherein each width of the curve surfaces of the stretchable member is smaller than each width of the protective members.

5. The glove according to claim 4, wherein each width of the curve surfaces of the stretchable member is not more than ¾ of a maximum finger width of a back portion of the third finger (middle finger) covering part, the maximum finger width being taken in a direction perpendicular to the center line of the back portion of the third finger covering part.

6. The glove according to claim 1, wherein when the glove is placed in a stationary state and is viewed from the back side, the shape of each of the curve surfaces formed by the stretchable member is in a shape of at least one selected from a letter S, a letter Z, and a combination thereof.

7. The glove according to claim 1, wherein the stretchable member is formed with a two-way stretchable knitted fabric.

8. The glove according to claim 1, wherein an extension ratio of a 5 cm-wide piece of the stretchable member under a load of 4.9 N (500 gf) is in a range of 5 to 150% both in the longitudinal and lateral directions.

9. The glove according to claim 1, wherein the protective members are formed with at least one selected from natural leathers and artificial leathers.

10. The glove according to claim 1, wherein a first arc from an upper end of the protective member has a curvature such that a radius (R) is in a range of not less than 3 mm and not more than 20 mm.

11. The glove according to claim 1, wherein, with a center of the upper end of each curve surface of the stretchable member being assumed to be a base point, an angle formed between a line extended from the base point to a top of a bulge of a first arc of the stretchable member and a line extended from the top of the bulge of the first arc to a top of a bulge of a next arc thereof is in a range of not less than 80° and not more than 110°.

12. The glove according to claim 11, wherein, at a substantial center of each of the finger covering parts of the glove, a notch-like portion formed of a stretchable member is provided in parallel with each first arc.

13. The glove according to claim 1, wherein the protective members are extended to the wrist part.

14. The glove according to claim 1, wherein the protective members are configured to form three or more separate curve surfaces.

* * * * *